US007077931B2

(12) United States Patent
Snekkenes et al.

(10) Patent No.: US 7,077,931 B2
(45) Date of Patent: Jul. 18, 2006

(54) METHOD AND BLEACHING LINE WITH A MAIN CONDUIT FOR WASH LIQUOR

(75) Inventors: Vidar Snekkenes, Karlstad (SE); Lennart Gustavsson, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 247 days.

(21) Appl. No.: 10/756,234

(22) Filed: Jan. 13, 2004

(65) Prior Publication Data

US 2004/0149404 A1 Aug. 5, 2004

(30) Foreign Application Priority Data

Jan. 31, 2003 (SE) ..... 0300276

(51) Int. Cl.
*D21C 9/02* (2006.01)
*D21D 9/10* (2006.01)

(52) U.S. Cl. ..... 162/70; 162/60; 162/232; 162/89; 8/156; 68/175; 68/181 R; 68/184

(58) Field of Classification Search ..... 162/60, 162/67, 89, 17, 19, 29, 37, 52, 70, 190, 65, 162/88, 41, 43; 8/156
See application file for complete search history.

(56) References Cited

U.S. PATENT DOCUMENTS

| | | | | |
|---|---|---|---|---|
| 3,698,995 | A | 10/1972 | Rapson | |
| 4,104,114 | A | 8/1978 | Rowlandson et al. | |
| 4,762,146 | A * | 8/1988 | Ewbank et al. | 137/625.3 |
| 5,403,441 | A * | 4/1995 | McDonald | 162/38 |
| 5,853,535 | A * | 12/1998 | Maples et al. | 162/30.1 |
| 6,106,667 | A * | 8/2000 | Henricson | 162/37 |

FOREIGN PATENT DOCUMENTS

EP 1443144 A1 * 8/2004

* cited by examiner

*Primary Examiner*—Dionne A. Walls
*Assistant Examiner*—Anna L. Kinney
(74) *Attorney, Agent, or Firm*—Rolf Fasth; Fasth Law Offices

(57) ABSTRACT

The method is for bleaching cellulose pulp in a bleach line that has at least two bleaching steps. The filtrate distribution is led up through the bleaching line counter-currently to the flow of cellulose pulp established in the bleaching line. A single joint main conduit is used for the bleaching steps. Wash filtrates obtained from the wash steps, used after or before the bleaching step, are led in conduits to branch locations on the train conduit that are positioned downstream of the branch location for drawing off of wash and/or dilution liquor for the wash step in question. All branch points in the joint main conduit are in fluid communication with one another along the main conduit.

24 Claims, 2 Drawing Sheets

METHOD AND BLEACHING LINE WITH A MAIN CONDUIT FOR WASH LIQUOR

PRIOR APPLICATION

This application is a U.S. national phase application claiming priority from Swedish Patent Application No. 0300276-3, filed 31 Jan. 2003.

The present invention relates to a method of bleaching cellulose pulp and a bleach line for the method.

PRIOR ART

It is a desire in multi-stage bleaching of cellulose pulp to reduce the water requirement and the quantity of outlet contaminated process water, which contaminated process water is either pumped to sewage, possibly via sedimentation basins and/or to costly destruction/deposition. With the object of reducing the liquor quantities, the bleaching department is ever more closed and most often the process water is lead in counter-current to the direction of flow of the cellulose pulp in the process steps of the bleaching line. Accordingly, the fresh water or the clean process water is used in the wash of the last step and the wash filtrate obtained there from is led as wash liquor to the wash of the preceding step and further up through the bleaching line. Commonly, a number of filtrate tanks are used between each bleaching step wash for this leading of wash filtrate through the process, with the object of guaranteeing supply of wash liquor and securing that the wash liquor is lead in counter-current to the flow of cellulose pulp. In addition to such filtrate tanks, expensive control and regulation systems with valves are required for this handling of the wash liquor in filtrate tanks, to monitor the levels in the filtrate tanks since the risk can not be taken that a filtrate tank is emptied whereby it may cause a stoppage in the wash of the bleaching step in question. The number or filtrate tanks also results in a risk of an increased outlet of odorous gases as all filtrate tanks require ventilation in order to level out changes in the volume in the filtrate tanks. Often, special degassing systems are required to handle and destruct such odorous gases. Accordingly, big advantages could be attained if the number of filtrate tanks between the process steps could be minimised.

THE OBJECT AND PURPOSE OF THE INVENTION

One object of the invention is to reduce the need of, and in some cases completely eliminate, such expensive filtrate tanks, control systems and valves in the wash liquor systems, whereby the investment costs for the bleaching line may be strongly reduced. The reduced number of necessary filtrate tanks also results in the possibility of a more compact and more optimal design of the bleaching line, without consideration of such filtrate tanks that conventionally numbers to at least the same number as the number of bleaching steps, with a more efficient layout of the bleaching steps of the bleaching line.

Yet another object is to increase the runnability/accessibility of the system as several control valves may be removed, that otherwise are always potential risks for plugging/stoppage of the liquor distribution system.

Yet another object is to improve the runnability as the risk of mixing-in of air in the filtrate system is considerably reduced when the number of filtrate tanks can be considerably reduced. At the same time, accumulation of floating pulp is avoided, which floating pulp usually accumulates after a certain running time, by surface flotation in filtrate tanks. Principally in alkaline steps, such accumulated floating pulp may rise to a level of a few metres above the surface in the filtrate tanks and it must be continuously taken care of or recycled to the bleaching line in order not to risk plugging of the filtrate systems.

Yet another object is that the bleaching plant can be rendered more environmentally friendly as occasional overloads in certain positions, so called over-runs, need not result in outlet of gas or liquor. Yet another object is to minimise the water consumption. By the system, the system itself may compensate for occasional changes in wash liquor requirements in the various bleaching steps and secure that a required wash liquor quantity is always guaranteed the bleaching steps.

It is yet another object to minimise the energy consumption in pumps in the filtrate distribution system, where instead a pressurised filtrate main conduit is maintained and any required liquor quantity is drawn off form the main conduit, as needed.

Yet another object is to decrease the length of the tube system, which reduces the costs of installation and the complexity of the system, whereby in the latter case the lucidity is also increased for the operators.

A cost reduction of between 1 and 2 millions USD can be obtained for a 4-step bleaching line $D_0$-EOP-$D_1$-$D_2$ with intermediate wash steps, if the invention is fully applied.

PRIOR ART

Figure 1:
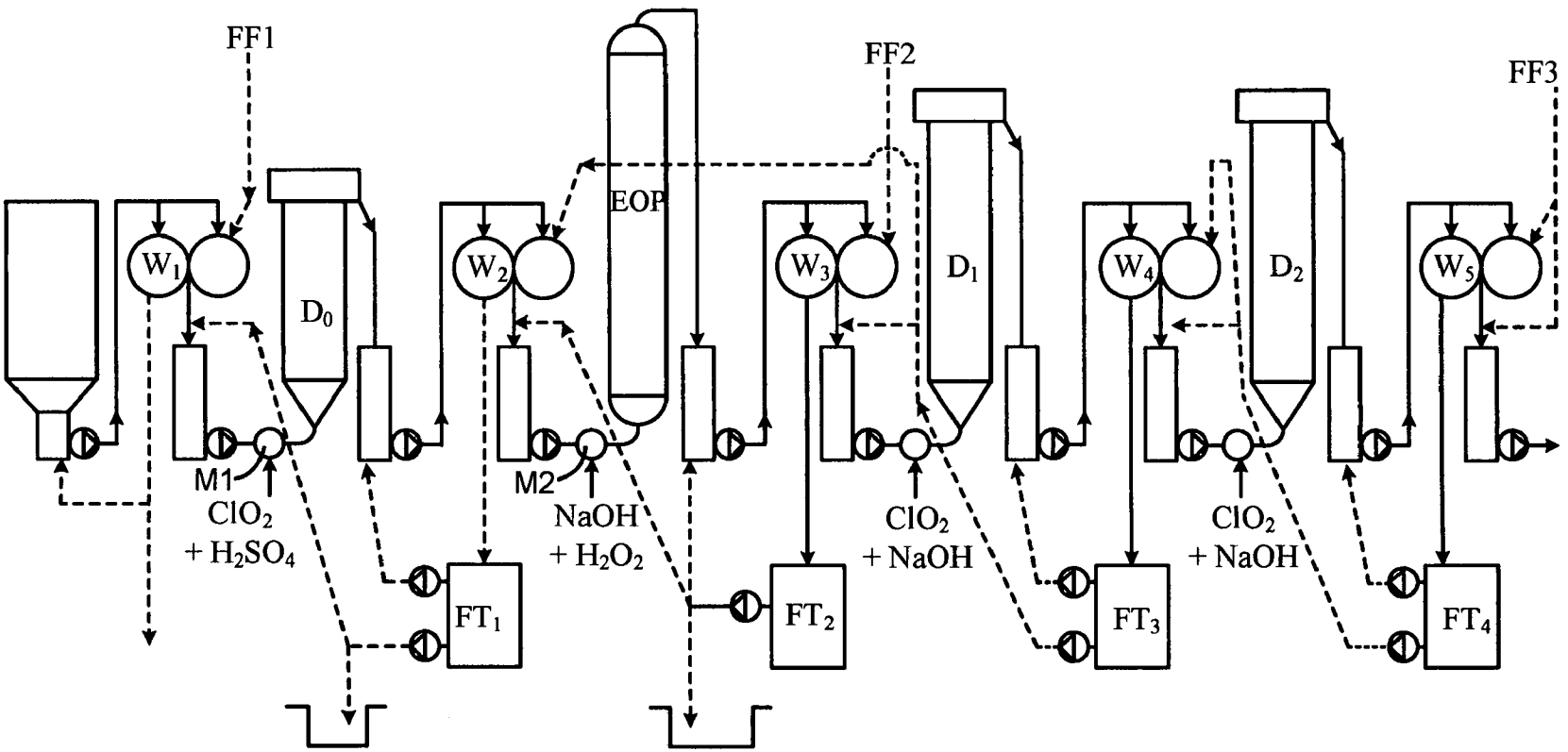
FIG. 1 Prior Art
FIG. 1 shows a conventional bleaching sequence $D_0$-EOP-$D_1$-$D_2$ in which the filtrate is led in counter-current, via filtrate tanks.

FIG. 1 shows a conventional bleaching sequence $D_0$-EOP-$D_1$-$D_2$ in which the filtrate from the washing between the steps is led in counter-current between the bleaching steps, via filtrate tanks $FT_1$–$FT_4$. The pulp is pumped by a pump from a first storage tower, to a first wash $W_1$ in which the pulp is washed with a clean first filtrate FF1. In the figure, wash apparatuses of wash press type are schematically shown, having two contra-rotating wash drums where wash liquor is supplied to the web of pulp on both drums, but subsequently the figure only shows the supply of wash liquor to one drum of the wash press. It is typical to such bleaching systems having wash presses that the bleaching takes place in reactors at a pulp consistency of 10–14% and that after treatment in the reactor, the pulp is diluted to about 5–10%, typically about 8%, before it is fed to the wash press. After the wash press, the pulp has a consistency of 20–35%, typically 30%.

After the first wash $W_1$, the washed pulp is fed down into a chute in which the pulp is diluted by a liquor that is pumped from a filtrate tank $FT_1$, from which chute it is pumped by a pump and a subsequent mixer M1 to a subsequent bleaching step, here a first chlorine dioxide step $D_0$ shown as an up-flow tower (the pulp flows upwards in the tower). The chemicals for the bleaching step, $ClO_2$ and acidifier $H_2SO_4$, are mixed-in by the mixer M1 before the pulp is led to the $D_0$ bleaching tower. After the bleaching in the $D_0$ bleaching tower, the pulp is led to a chute in which the pulp is diluted by filtrate from the first filtrate tank $FT_1$. From the chute, the pulp is pumped to a subsequent wash $W_2$ in which the pulp is washed by wash liquor from a third filtrate tank $FT_3$. Thereafter, the pulp washed in the wash $W_2$ is led to a chute in which the pulp is diluted by filtrate from a second filtrate tank $FT_2$, and from the chute the pulp is pumped by a pump and a subsequent mixer M2 to a subsequent alkaline extraction step, here an EOP step shown as an up-flow tower. The chemicals for the extraction step, NaOH and peroxide $H_2O_2$, and oxygen gas if needed, are mixed in by the mixer M2 before the pulp is led to the EOP tower. After the treatment in the extraction tower EOP, the pulp is led to a chute in which the pulp is diluted by filtrate from the second filtrate tank $FT_2$, where after the pulp is pumped to a subsequent wash $W_3$. In the wash $W_3$, the pulp is washed by clean filtrate FF2. After the wash $W_3$, the washed pulp is fed down to a chute in which the pulp is diluted by filtrate from a third filtrate tank $FT_3$, where after the pulp is pumped by a pump and a subsequent mixer to a subsequent bleaching step, here a second chlorine dioxide step $D_1$, shown as an up-flow tower. The chemicals for the $D_1$ bleaching step, $ClO_2$ and pH-adjuster, are mixed in by the mixer before the pulp is led to the $D_1$ bleaching tower. As an alternative, the adjusting of pH can take place by addition of e.g. NaOH in the preceding chute. After the treatment in the $D_1$ bleaching tower, the pulp is led to a chute in which the pulp is diluted by filtrate from the third filtrate tank $FT_3$, where after the pulp is pumped to a subsequent wash $W_4$. In the wash $W_4$, the pulp is washed by filtrate from a fourth filtrate tank $FT_4$.

After the wash $W_4$, the washed pulp is fed down to a chute in which the pulp is diluted by filtrate from a fourth filtrate tank $FT_4$, where after the pulp is pumped by a pump and a subsequent mixer to a subsequent bleaching step, here a third chlorine dioxide step $D_2$, shown as an up-flow tower. The chemicals for the $D_2$ bleaching step, $ClO_2$ and pH-adjuster, are mixed in by the mixer before the pulp is led to the $D_2$ bleaching tower. As an alternative, the adjusting of pH can take place by addition of e.g. NaOH in the preceding chute. After the treatment in the $D_2$ bleaching tower, the pulp is led to a chute in which the pulp is diluted by filtrate from the fourth filtrate tank $FT_4$, where after the pulp is pumped to a subsequent wash $W_5$. In the wash $W_5$, the pulp is washed by clean filtrate FF3. The pulp bleached by the shown bleaching sequence, $D_0$-EOP-$D_1$-$D_2$, is subsequently led to a storage tower (not shown) and typically has a brightness above ISO 80 and is often a fully bleached pulp of ISO 90. In certain cases, a subsequent treatment can be used to modify the properties of the pulp in respect of drainage properties etc. The main principle of the filtrate distribution of the shown bleaching sequence is that there are filtrate tanks between the treatment steps, which filtrate tanks receive the filtrate from the wash in question. The filtrate tank $FT_4$ of the last wash $W_5$ collects the filtrate and then the filtrate is led in counter-current to the flow of pulp through the bleaching line, via pumps, and is used as dilution or wash liquor in preceding positions. In a corresponding manner, filtrate from the wash apparatuses $W_4$, $W_3$, $W_2$ is collected in the filtrate tanks $FT_3$, $FT_2$ and $FT_1$, respectively, and then the filtrate is led via pumps, from the respective tank in counter-current to the flow of pulp through the bleaching line. In certain circulations, a certain share of the filtrate is also bled off, as is shown in the feed from the filtrate tanks $FT_1$ and $FT_2$, in order to avoid accumulation of increasing contents of undesired substances, which bleeding-off is compensated by supply of cleaner filtrates FF1 and FF2. The bleeding-off of filtrate is the principle outlet from the bleaching line. In this counter-current filtrate distribution, alkaline filtrate is separated from acidic. Accordingly, the alkaline filtrate from the EOP step is collected in the filtrate tank $FT_2$, and no acidic filtrate is used in the wash $W_3$, but instead clean filtrate FF2 is used. In certain applications, such alkaline filtrate can be fed on, upstream, to the oxygen delignification, where it is used as wash liquor in the wash after the oxygen delignification. For the acidic filtrates that are collected in the filtrate tanks $FT_4$, $FT_3$ and $FT_1$, the wash liquor is led strictly counter-current to the flow of pulp, i.e. from $FT_4$ to $FT_3$, and finally to $FT_1$ from where the acidic filtrate is bled off from the bleaching department since it can not be handled in the recovery system, mainly due to high contents of chloride that destroy the soda recovery boiler.

DETAILED DESCRIPTION OF A PREFERRED EMBODIMENT

Figure 2:
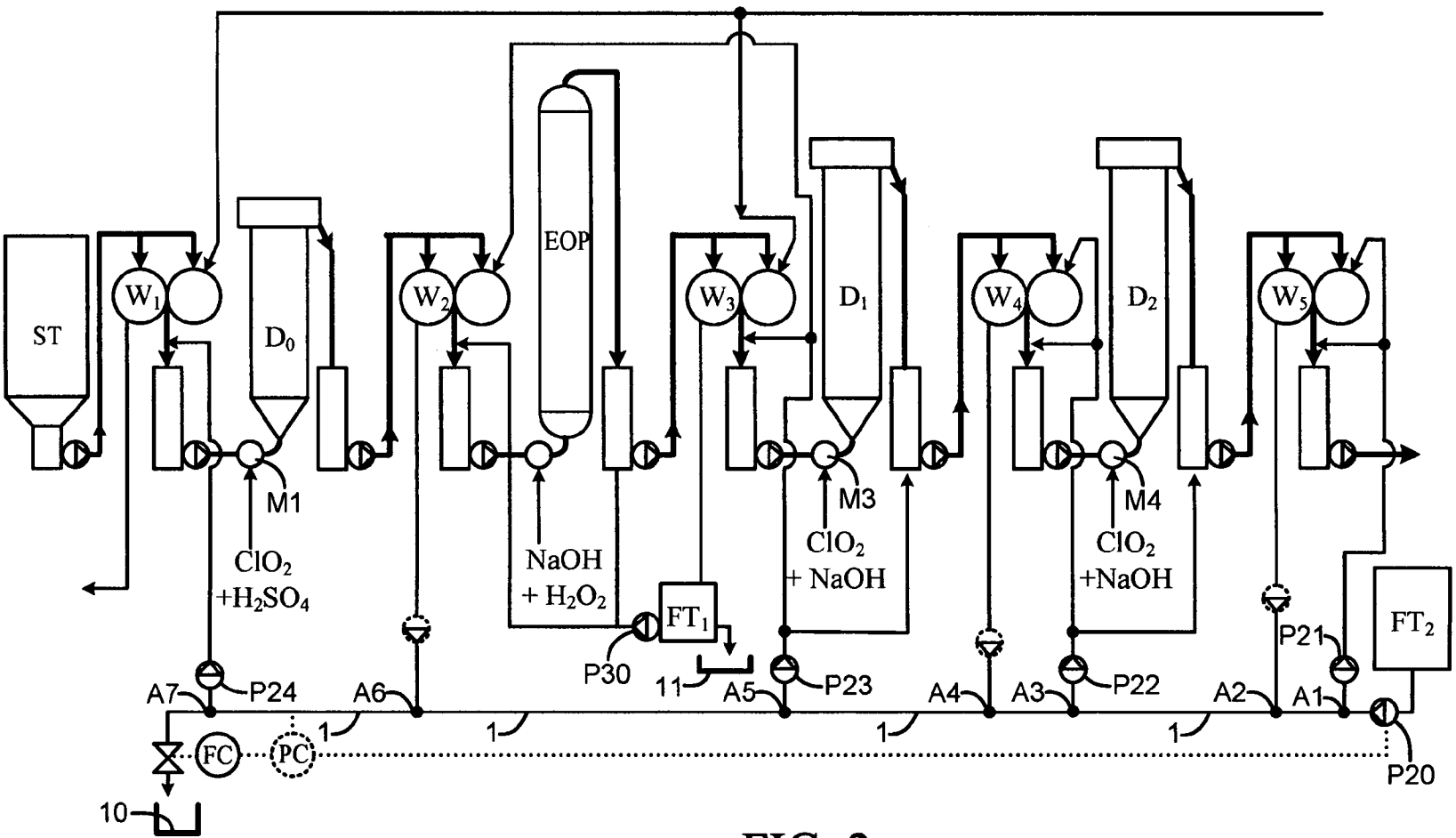
FIG. 2 shows the same bleaching sequence D0-EOP-D1-D2 in which filtrate is led between the steps in accordance with the present invention.

FIG. 2 shows an embodiment of the invention, in which the filtrate distribution system instead of the large number of filtrate tanks, has been replaced by a joint main conduit 1 for all acidic bleaching steps.

Here, bleaching of the cellulose pulp takes place in a bleaching line with at least two bleaching steps in the bleaching line and at some point including a first and a second bleaching step $D_1$, $D_2$ in succession, as seen in the flow direction of the cellulose pulp, which bleaching steps have wash apparatuses $W_4$ and $W_5$ for the pulp arranged after the first and the second bleaching step, respectively. Wash liquor and where appropriate dilution liquor, is led in principle in counter-current to the flow of pulp through the bleaching steps of the bleaching line, which flow of pulp (bold arrows are flow lines) passes through the sequence $W_1$-$D_0$-$W_2$-EOP-$W_3$-$D_1$-$W_4$-$D_2$-$W_5$. The wash liquor is supplied to a main conduit 1 that is arranged in parallel to the bleaching line, by a pump P20 from a filtrate tank $FT_2$, and at least one of wash liquor and dilution liquor is taken to the subsequent wash $W_5$ of the second bleaching step $D_2$, from a first branch position A1 in the main conduit and at least a part of the wash filtrate from the subsequent wash of the second bleaching step is led to a second branch position A2 in the main conduit. At least one liquor of wash liquor and dilution liquor is taken to the subsequent wash $W_4$ of the first bleaching step $D_1$, from a third branch position A3 in the main conduit, and at least a part of the wash filtrate from the subsequent wash of the first bleaching step is led to a fourth branch position A4 in the main conduit. Here, the branch positions A1–A4 connect to the main conduit with the first branch position A1 arranged first, as seen in the direction of flow in the main conduit 1, and the second to fourth branch positions A2–A4 in succession thereafter, an open communication being established in the main conduit between the branch positions A1–A4. Upstream said first branch position A1 at the first end of the main conduit, a main pump device P20 is arranged which pressurises the main conduit and establishes a basic flow in the main conduit in a direction reverse to the formed flow of cellulose pulp in the bleaching line. In this embodiment, wash liquor is led from the first and the third branch position A1 and A3, respectively, to the respective wash apparatus $W_5$ and $W_4$, respectively, via pump devices P21 and P22, respectively.

The main conduit may suitably be used for additional bleaching steps of the same type if the main conduit, as in the figure, is used for a number of acidic steps or a number of alkaline steps (the latter is not shown in FIG. 2).

Accordingly, at least one additional bleaching step $D_0$ may be provided before the first and second bleaching steps $D_1$ and $D_2$, respectively, as seen in the flow direction of the cellulose pulp, after which additional bleaching step $D_0$ there is a wash apparatus $W_2$ for the pulp. At least one liquor of wash liquor and dilution liquor (wash liquor in the figure) is taken to the subsequent wash $W_2$ of the additional bleaching step, from a fifth branch position A5 in the main conduit 1 and at least a part of the wash filtrate from the subsequent wash $W_2$ of the additional bleaching step is led to a sixth branch position A6 in the main conduit. The branch positions connect to the main conduit with the fifth branch position A5 arranged after the fourth branch position A4, as seen in the direction of flow in the main conduit 1, and the sixth branch position A6 in succession thereafter, an open communication being established in the main conduit between the branch positions A1–A6.

In FIG. 2, an alkaline extraction step EOP or alternatively an EO step without peroxide charge is, in a per se conventional manner, arranged after the additional bleaching step $D_0$ and before the first bleaching step $D_1$, as seen in the direction of flow of the cellulose pulp through the bleaching line, and a wash apparatus $W_3$ is arranged after the extraction step EOP. The wash filtrate from the subsequent wash $W_3$ of the extraction step can be collected in a filtrate tank $FT_1$ and is suitably used as dilution liquor before the extraction step and a part of the wash filtrate can if needed be drawn off from the bleaching line, to sewage 11, or be led forward to an oxygen delignification step. In this embodiment, the cellulose pulp is washed in a wash apparatus $W_1$ before the additional bleaching step $D_0$, as seen in the direction of flow of the cellulose pulp through the bleaching line and at least one liquor of wash liquor and dilution liquor is taken to this wash apparatus $W_1$, in the figure only dilution liquor, from a seventh branch position A7 in the main conduit.

According to the shown embodiment, at least chlorine dioxide, or some other bleaching chemical that is compatible throughout the bleaching steps, is used as active bleaching agent in the bleaching steps $D_0$, $D_1$ and $D_2$, which chlorine dioxide is added to the pulp before the respective bleaching step in a blending apparatus M1, M3 and M4, respectively.

At the other end of the main conduit, as seen after the branch points A1–A7, an outlet 10 is suitably provided, from which wash liquor and filtrate can be drawn off. Preferably, the outlet is controlled by a flow controlling control valve FC, which control valve can establish a certain basic flow and/or a desired bleed-off level of filtrate, during normal operation. The pump P20 is controlled by a pressure regulator PC, enabling feed-back control of the main pump device P20 in order to secure a predetermined pressure and/or flow throughout the entire main conduit 1. Suitably, the flow controlling valve can establish a desired flow to the outlet 10 as long as the pressure in the main conduit can be maintained. In an alternative embodiment, the flow controlling valve FC may be a fixed or variable throttle valve with a high pressure drop over the valve.

By the embodiment shown in FIG. 2, a bleaching line is provided for the bleaching of cellulose pulp, having at least two bleaching steps comprising a first and a second bleaching step $D_1$ and $D_2$, respectively, as seen in the flow direction of the cellulose pulp, which bleaching steps have wash apparatuses $W_4$ and $W_5$ for the pulp arranged after the first and the second bleaching step, respectively, and in which wash liquor and where appropriate dilution liquor is led in principle in counter-current to the pulp flow through the wash apparatuses $W_1$–$W_5$ in the bleach line $W_1$-$D_0$-$W_2$-EOP-$W_3$-$D_1$-$W_4$-$D_2$-$W_5$. The wash liquor is supplied in a main conduit 1 that is arranged in parallel to the bleaching line, and at least one of wash liquor and dilution liquor is taken to a subsequent wash $W_5$ of a second bleaching step $D_2$, from a first branch position A1 in the main conduit 1 and at least a part of the wash filtrate from the subsequent wash of the second bleaching step is led to a second branch position A2 in the main conduit. At least one liquor of wash liquor and dilution liquor is taken to a subsequent wash $W_4$ of a first bleaching step $D_1$ from a third branch position A3 in the main conduit 1, and at least a part of the wash filtrate from the subsequent wash of the first bleaching step is led to a fourth branch position A4 in the main conduit. According to the invention, the branch positions A1–A4 connect to the main conduit 1 with a first branch position A1 arranged first, as seen in the direction of flow in the main conduit, and second A2 to fourth A4 branch positions in succession thereafter, an open communication being established in the main conduit between the branch positions A1–A4.

Pressurisation and distribution of filtrate takes place via a main pump device P20, arranged upstream the first branch position A1 in the main conduit. The low side of the main pump device P20 is connected to a liquor tank $FT_2$, and its high side pressurises the main conduit 1 and establishes a basic flow in the main conduit, reverse to the formed flow of cellulose pulp in the bleaching line.

From the first and third branch positions A1 and A3, respectively, wash liquor is led from the main conduit 1 to the respective wash apparatuses $W_5$ and $W_4$, via pump devices P21 and P22, respectively, and associated tubing.

The bleaching line preferably also includes at least one additional bleaching step $D_0$, which is arranged before the first and second bleaching steps $D_1$ and $D_2$, as seen in the direction of flow of the cellulose pulp. After this additional bleaching step $D_0$, a wash apparatus $W_2$ for the pulp is arranged. At least one liquor of wash liquor and dilution liquor is taken to the subsequent wash $W_2$ of the additional bleaching step, from a fifth branch position A5 in the main conduit 1 and at least a part of the wash filtrate from the subsequent wash of the additional bleaching step is led to a sixth branch position A6 in the main conduit 1. The branch positions A5–A6 connect to the main conduit 1 with the fifth branch position A5 arranged after the fourth branch position A4, as seen in the direction of flow in the main conduit, and the sixth branch position A6 in succession thereafter, an open communication being established in the main conduit between the branch positions A1–A6.

An extraction step is arranged in the shown bleaching line, preferably of EOP or EO type, which is arranged after the additional bleaching step $D_0$ and before the first bleaching step $D_1$, as seen in the direction of flow of the cellulose pulp through the bleaching line, and a wash apparatus $W_3$ is arranged after the extraction step. The wash filtrate from the subsequent wash $W_3$ of the extraction step is led to a filtrate tank $FT_1$, via a conduit, and filtrate from the filtrate tank is, at least partly, led as dilution liquor after the wash step $W_2$ subsequent to the additional bleaching step $D_0$, via pump P30 and conduits, and a part of this wash filtrate is when needed drawn off from the process, preferably via an outlet from the filtrate tank $FT_1$. As shown in the figure, a part of the liquor in the filtrate tank may also be used as dilution liquor in the chute after the EOP reactor.

In the bleaching line, cellulose pulp is washed in a wash apparatus $W_1$ before the additional bleaching step $D_0$, as seen in the direction of flow of the cellulose pulp through the bleaching line, and to this wash apparatus $W_1$ at least one liquor of wash liquor and dilution liquor is led from a seventh branch position A7 in the main conduit 1 to the wash apparatus $W_1$, via a pump device P24 and associated tubing.

If the pulp in the storage tower ST is acidic, both wash and dilution liquor in and after the wash $W_1$, respectively, can be taken from the main conduit. But if the pulp in the storage tower is alkaline, a cleaner alkaline filtrate or a clean filtrate is used as wash liquor in the wash apparatus $W_1$, where the use of a clean filtrate is shown in FIG. 2.

In the bleaching steps $D_0$, $D_1$, $D_2$ of the bleaching line, at least chlorine dioxide is charged as active bleaching agent or some other bleaching chemical that is compatible throughout the bleaching steps, such as a chelating agent, a pH adjuster or some additional bleaching chemical, which chlorine dioxide or bleaching chemical is added to the pulp before the respective bleaching step in a blending apparatus M1, M3 and M4, respectively.

At the end of the main conduit 1, as seen after the branch points A1–A7, an outlet 10 is provided, from which wash liquor and filtrate can be drawn off from the main conduit. Suitably, the outlet 10 is controlled as is described above, by a pressure and/or flow controlling control valve PC and/or FC.

The invention can be varied in a number of ways, within the scope of the claims. The bleaching steps that in their subsequent wash apparatuses have a joint main conduit that receives wash filtrate and dilution and/or wash liquor may, for example, all be of alkaline type or the bleaching chemicals in question may be compatible/blendable. In multi-stage bleaching sequences, a main conduit may be used for the alkaline filtrate from two or more alkaline steps and another main conduit may be used for the acidic filtrate from two or more acidic steps.

In the embodiment shown in FIG. 2, the pumps P21–P24 are placed in the feed conduits from the main conduit. In an alternative embodiment, powerful pumps may be provided in the return conduits that connect to the branch points A2, A4 and A6, respectively, which in such case, together with the main pump P20, pressurise the entire main conduit. With a pressure in the main conduit established at 4 bar, pumps in the feed conduits for dilution and/or wash liquor can normally be eliminated. The supply of dilution liquor after wash normally requires a very low pressure of about 1 bar, why a throttle is required for such dilution liquor supply. Normally, the dilution liquor is supplied to an atmospheric dilution screw in which fluffed-up pulp of high consistency, about 30%, is blended with dilution liquor to a consistency suitable for subsequent pumping. Therefore, there is a low pressure need on the liquor supply. In another, alternative embodiment, a basic pressure of about 1 bar may be established in the main conduit, which is enough to feed dilution water, but in which a supplying pump is provided in the feed conduit for the wash liquor. Normally, wash liquor is added in a converging wash slot in a wash press at a higher pressure and normally, a wash liquor pressure of at least 2–4 bar is required in this position. As an additional precautionary measure, a check valve may be provided between the branch positions for filtrate recycling to the main conduit and feeding of dilution and/or wash liquor to the wash apparatus in question, especially if the branch positions of construction reasons are close to each other. The most important aspect is that an open communication is established between all branch points in the main conduit, as seen in the direction from the first end of the main conduit, with the filtrate tank FT2, to the second end of the main conduit, with the outlet 10.

Other wash apparatuses than wash presses may of course be used. At less heavy requirements on chemical carry-over to the subsequent bleaching step, ordinary filters or simple presses (without washing) may of course be used, in which the filtrate from the filter or the simple press is led to the main conduit and optional dilution liquor before the filter or the press is taken from the main conduit. Also, wash presses such as a filter or a simple press without wash, may be connected to a joint main conduit.

The invention claimed is:

1. A method of bleaching cellulose pulp in a bleaching line, comprising:

providing the bleaching line having a first and a second bleaching step, as seen in a direction of flow of the cellulose pulp, the bleaching steps having a first wash apparatus and a second wash apparatus for the cellulose pulp arranged downstream of the first and the second bleaching step, respectively, directly connecting first, second, third and fourth branch conduits to a main conduit with the first branch conduit arranged first, as seen in a direction of a flow in the main conduit, and the second to fourth branch conduits in succession thereafter so that the first, second, third and fourth branch conduits are in direct fluid communication with one another via the main conduit, supplying a wash liquor in the main conduit that is arranged in parallel to the bleaching line, leading the wash liquor in the main conduit countercurrently to the flow of the cellulose pulp, diverting wash liquor, flowing in the main conduit, to the second wash apparatus of the second bleaching step, via the first branch conduit connected to the main conduit, leading a first portion of a wash filtrate from the second wash apparatus of the second bleaching step to the main conduit via the second branch conduit connected to the main conduit, diverting wash liquor, flowing in the main conduit, to the first wash apparatus of the first bleaching step via the third branch conduit connected to the main conduit, and leading a second portion of the wash filtrate from the first wash apparatus of the first bleaching step via the fourth branch conduit connected to the main conduit.

2. A method according to claim 1, wherein the main conduit is connected to receive and distribute acidic filtrate from and to, respectively, acidic bleaching steps.

3. A method according to claim 2, wherein upstream of the first branch conduit in an upstream first end of the main conduit, a main pump device is provided which pressurizes the main conduit and pumps the wash liquor in the main conduit in a direction reverse to the flow of cellulose pulp in the bleaching line.

4. A method according to claim 3, wherein the wash liquor is led to the first and second wash apparatuses via pump devices.

5. A method according to claim 3, wherein the first and second portions of the wash filtrate are led to the main conduit via pump devices.

6. A method according to claim 1, wherein the main conduit is connected to receive and distribute alkaline filtrate from and to, respectively, alkaline bleaching steps.

7. A method according to claim 1 comprising:

providing an additional bleaching step upstream of the first and second bleaching steps, as seen in a direction of flow of the cellulose pulp, after the additional bleaching step providing a third wash apparatus for the cellulose pulp, conveying wash liquor in a fifth branch conduit, connected to the main conduit, to the third wash apparatus of the additional bleaching step, and leading a third portion of the wash filtrate from the third wash apparatus of the additional bleaching step to the main conduit via a sixth branch conduit connected to the main conduit.

8. A method according to claim 7, wherein an extraction step is provided after the additional bleaching step and before the first bleaching step, as seen in the direction of flow of the cellulose pulp through the bleaching line.

9. A method according to claim 8, wherein wash filtrate from a fourth wash apparatus of the extraction step is used as a dilution liquor for the third wash apparatus.

10. A method according to claim 7, wherein wash liquor in the main conduit is led via a seventh branch conduit to a fifth wash apparatus that is upstream of the fourth wash apparatus, as seen in the direction of flow of the cellulose pulp through the bleaching line.

11. A method according to claim 7 wherein at least a bleaching chemical, that is compatible throughout the bleaching steps, is used as an active bleaching agent in the bleaching steps.

12. A method according to claim 7 wherein the method further comprises drawing off wash liquor from a downstream outlet end of the main conduit.

13. A method according to claim 12, wherein the outlet is controlled by a pressure and/or flow controlling control valve.

14. A bleaching line for bleaching of cellulose pulp, having at least two bleaching steps comprising:

a first and a second bleaching step, as seen in a flow direction of the cellulose pulp, the bleaching steps having a first wash apparatus and a second wash apparatus for the cellulose pulp arranged after the first and the second bleaching steps, respectively, and in which wash liquor and dilution liquor are led in counter-current to the flow direction of the cellulose pulp through the wash apparatuses of the bleaching steps in a bleach line, the wash liquor being supplied in a main conduit that is arranged in parallel to the bleaching line, a first branch conduit connected to an inlet of the second wash apparatus for carrying a wash liquor to the second wash apparatus, a second branch conduit connected to an outlet of the second wash apparatus for carrying a first portion of a wash filtrate away from the second wash apparatus to the main conduit, a third branch conduit connected to an inlet of the first wash apparatus for carrying a second portion of the wash liquor to the first wash apparatus, a fourth branch conduit connected to an outlet of the first wash apparatus for carrying a second portion of the wash filtrate away from the first wash apparatus to the main conduit, the first, second, third and fourth branch conduits being directly connected to the main conduit with the first branch conduit arranged first, as seen in a direction of a flow in the main conduit, and the second to fourth branch conduits in succession thereafter so that the first, second, third and fourth branch conduits are in direct fluid communication with one another via the main conduit.

15. A bleaching line according to claim 14, wherein the main conduit is connected to receive and distribute acidic filtrate from and to acidic bleaching steps, respectively.

16. A bleaching line according to claim 15 wherein a main pump device (P20) is arranged upstream the first branch conduit in the main conduit.

17. A bleaching line according to claim 16 wherein the first branch conduit has a first pump associated therewith and the third branch conduit has a third pump associated therewith.

18. A bleaching line according to claim 16 wherein the second branch conduit has a second pump associated therewith and the fourth branch conduit has a fourth pump associated therewith.

19. A bleaching line according to claim 14 wherein the main conduit is connected to receive and distribute alkaline filtrate from and to alkaline bleaching steps, respectively.

20. A bleaching line according to claim 14 wherein an additional bleaching step is provided before the first and second bleaching steps, as seen in the flow direction of the cellulose pulp.

21. A bleaching line according to claim 20 wherein an extraction step is provided after the additional bleaching step and before the first bleaching step, as seen in the flow direction of the cellulose pulp through the bleaching line.

22. A bleaching line according to claim 14 wherein a bleaching chemical that is compatible throughout the bleaching steps, is charged as active bleaching agent in the bleaching steps.

23. A bleaching line according to claim 14 wherein the main conduit has a downstream outlet end.

24. A bleaching line according to claim 23 wherein the outlet end is controlled by a pressure or flow controlling control valve.

* * * * *